United States Patent [19]

Mustonen

[11] 4,240,558

[45] Dec. 23, 1980

[54] SELF-PROPELLED CRANE WITH A TELESCOPIC BOOM AND ADDITIONAL BOOM MEANS

[76] Inventor: Eelis J. Mustonen, Kiveläntie 5, Kuopio, Finland

[21] Appl. No.: 898,960

[22] Filed: Apr. 21, 1978

Related U.S. Application Data

[63] Continuation of Ser. No. 703,774, Jul. 9, 1976, abandoned.

[30] Foreign Application Priority Data

Jul. 15, 1975 [FI] Finland ..... 752038
Feb. 16, 1976 [FI] Finland ..... 760375

[51] Int. Cl.[3] ..... B66C 23/00
[52] U.S. Cl. ..... 212/175; 212/200; 212/203
[58] Field of Search ..... 212/46, 56, 60, 64, 212/33, 34, 59 R, 57, 8 R

[56] References Cited

U.S. PATENT DOCUMENTS

| | | | |
|---|---|---|---|
| 229,624 | 7/1880 | Marsters | 212/57 |
| 256,371 | 4/1882 | Reeves | 212/57 |
| 339,818 | 4/1886 | Soseman | 212/64 |
| 984,670 | 2/1911 | Heedwell et al. | 212/64 |
| 3,894,635 | 7/1975 | Reich | 212/46 B |

*Primary Examiner*—Lawrence J. Oresky
*Attorney, Agent, or Firm*—Pennie & Edmonds

[57] ABSTRACT

In a self-propelled crane with a crane frame constituting the base for a telescopic boom an additional boom articulatedly supported to any other part of the telescopic boom than the upper end thereof or to the crane frame and an additional supporting arm mounted to the telescopic boom on the opposed side thereof in relation to the additional boom, said additional boom being supported by a wire which is supported both in a point of the telescopic boom above the mounting point of said additional boom and by the additional supporting arm. Both the additional boom and the additional supporting arm are preferably mounted in the same or separate mounting elements which are adjustably and controllably movable along the telescopic boom or the crane frame.

2 Claims, 4 Drawing Figures

SELF-PROPELLED CRANE WITH A TELESCOPIC BOOM AND ADDITIONAL BOOM MEANS

This is a continuation of application Ser. No. 703,774 filed July 9, 1976 now abandoned.

BACKGROUND OF THE INVENTION

1. Field of the Invention

The present invention relates to a self-propelled crane of telescopic boom type and provided with additional boom means to improve the lifting capacity of the crane and increase the possibilities for its use in limited working spaces. A greater lifting capacity is needed, for example, in situations wherein the maximum allowed weight of the load to be lifted is limited by either the risk of the crane to tip over or by the loading values of some structural part. Increased possibilities for using the crane in limited working spaces are needed, for example, in situations wherein an obstacle below the telescopic boom prevents lifting to a great distance owing to the limited lowering possibilities.

2. Description of the Prior Art

Previously known are additional booms which are installed at the upper end of the topmost boom part, either rigidly without supporting hoists or journal bed and supported by wires or hydraulic elements, for example.

These additional booms have a disadvantage in that the positions of the additional boom and the supporting wires cannot be easily adjusted to suit each lifting task from the operator cab by means of the telescopic boom. Another disadvantage is the great bending moment the telescopic boom will be exposed to. Due to the big stresses the maximum lifting capacity achieved within a certain distance is considerably less with telescopic booms provided with an additional boom installed at the upper end of the telescopic boom than the lifting capacity achieved within the same distance with the same crane provided with additional booms according to the invention.

SUMMARY OF THE INVENTION

According to the invention a self-propelled crane with a telescopic boom is in order to improve the lifting capacity of the crane and increase the possibilities for its use in limited working spaces, provided with an additional boom which is articulatedly supported to any other part of the telescopic boom than the upper end thereof or to the crane frame, which is acting as the base for the telescopic boom, the part of the telescopic boom above the mounting point of the additional boom serving as a supporting base for the supporting wires of the additional boom, and further provided with an additional supporting arm mounted to the telescopic boom on the opposed side thereof in relation to the additional boom, said supporting arm constituting a support for said wires supporting the additional boom.

The object of the invention is to improve the lifting capacity of the crane and to increase the using possibilities in limited working spaces. By means of the additional boom means according to the invention it is possible to achieve even the double lifting capacity as compared with the previously known means.

Another advantage of the self-propelled crane according to the invention is that its conventional telescopic boom can be used alone for lighter lifting tasks in a manner known per se, and at the same time it can be used as an already existing construction as a strong base for the additional boom means according to the invention, which means are used for greater loads and when working in a congested space. The conventional telescopic boom of the self-propelled crane can be used as a regular lifting crane even when assembling the additional boom and the additional supporting arm and installing them to their supporting joints or when detaching them from the crane either in parts or assembled. For example, the additional boom means can be assembled on top of a high construction and then moved to their attachment joints.

The additional boom and the additional supporting arm according to the invention can be made considerably more lightweight than the telescopic boom itself and even more lightweight than an additional boom installed to the upper end of the telescopic boom, since the main load it is subjected to is pressure from the ends only some of the load being bending due to its own weight. The additional boom means can preferably be of the lattice work type. Owing to the lighter construction of the additional boom the tilting moment due to the weight of the parts extending outside the supports of the crane is reduced and the same effect is obtained by the heavy telescopic boom and the additional supporting arm acting on the opposite side in relation to the supporting points of the crane. Thus, considerably better lifting values are obtained with an additional boom and an additional supporting arm when lifting at a long distance than when lifting with a telescopic boom alone at a corresponding distance.

A further advantage with the additional boom means according to the invention is that loads can be lifted over tall obstacles close to the crane as with tower cranes, for example.

DESCRIPTION OF THE PREFERRED EMBODIMENTS

The principle of the additional boom means according to the invention is disclosed in the following with reference to the attached drawing showing some preferable embodiments of the invention.

Figures 1, 1A:
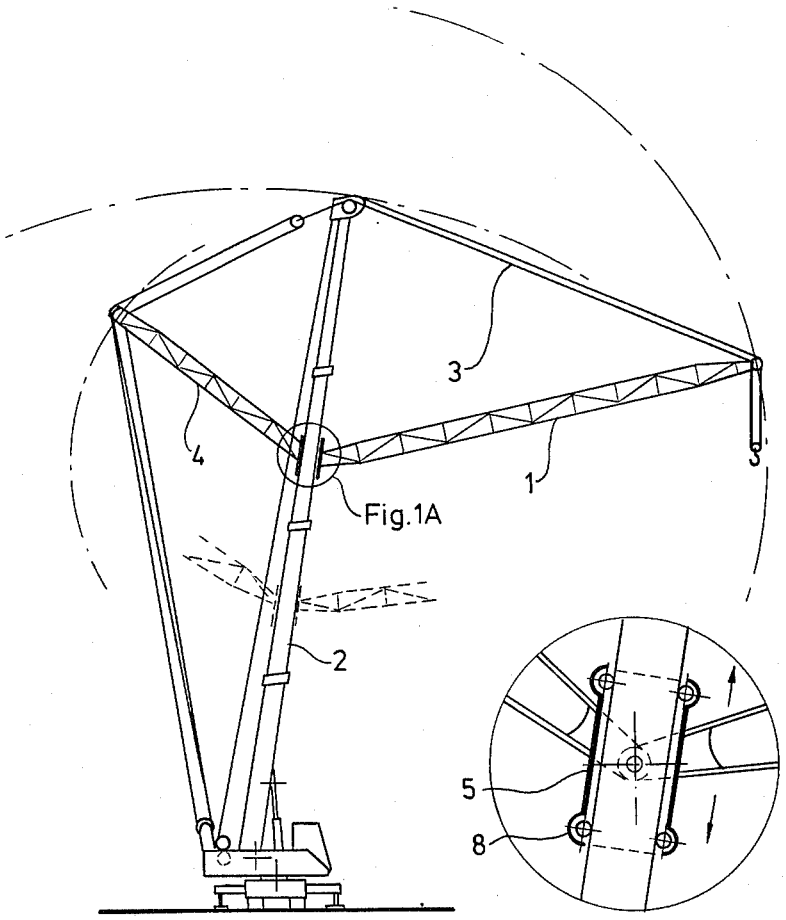
FIG. 1 is showing a side view of a preferable embodiment of the self-propelled crane provided with an additional boom and an additional supporting arm, both supported in a joint in the second topmost extension of the boom.
FIG. 1A shows the supporting element 5 of FIG. 1 in an enlarged scale.

In the figures the same elements are indicated by the same reference numerals. The additional boom is indicated by 1, the telescopic boom by 2, the supporting wires by 3, and the additional supporting arm by 4. The reference numeral 5 is indicating mounting element being movable along one extension part of the telescopic boom, said mounting element being movably attached to the middle extension part of the boom in FIG. 1 and to the lowest extension part in FIG. 2. The mounting element 5 is constituting the attachment element both for the additional boom 1 and the additional supporting arm 4 in FIGS. 1 and 2. Number 6 is indicating the frame of the crane constituting the base for the telescopic boom. The base part of the telescopic boom is indicated by 7 and the extension parts from the lowest to the topmost are indicated by 7', 7'', and 7'''. Number 8 is indicating the rolls of the supporting element 5.

Figure 2:
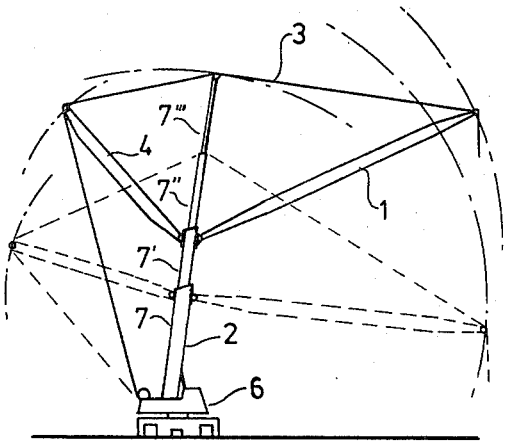
FIG 2 shows another preferable embodiment mainly similar to the embodiment of FIG. 1, but having both the additional boom and the additional supporting arm supported in the lowest extension of the boom and shown in two working positions.
Figure 3:
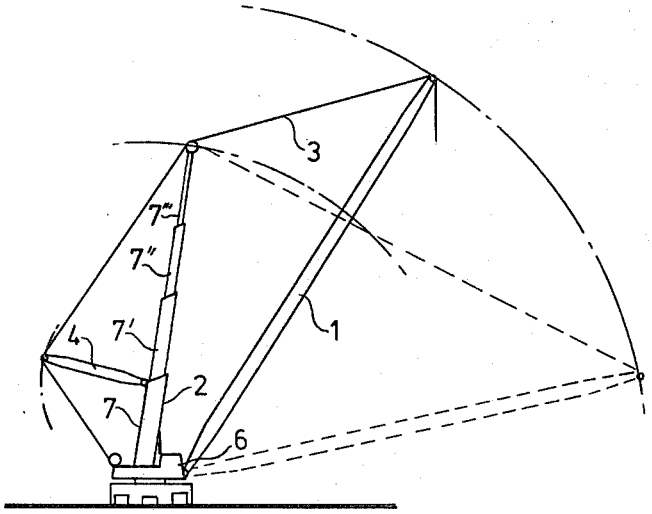
FIG. 3 shows another preferable embodiment having the additional boom supported in the frame of the crane and the additional supporting arm supported in the base part of the telescopic boom.

The additional boom 1 and the additional supporting arm 4 are both mounted to the mounting element 5 according to FIGS. 1 and 1A. Said mounting element is mounted to the middle extension part 7'' of the telescopic boom 2. In terms of strength, especially the bending strength of the telescopic boom, this is considerably more advantageous than attaching the additional boom to the topmost extension part and also considerably more advantageous than to use an additional boom without an additional supporting arm on the opposed side of the telescopic boom. The forces in the hoist and the supporting wires will be more advantageous to their direction and size in view of the loading of the crane structure thanks to the additional support arm 4 and accordingly better performance values are achieved. The part of the telescopic boom above the mounting element 5 is supporting the supporting wires 3 of the additional boom and of the additional supporting arm 4. In addition, when the telescopic boom 2 is used as a support for the supporting wires 3 of the additional boom 1, a more versatile control of the movements of the additional boom from the operator's cab is achieved than when using supporting wires of a predetermined length. The attachment point of the additional supporting arm is selected on the basis of strength calculations so that the most advantageous situation is achieved in view of the loading of the crane structure. Accordingly this attachment point may in some cases be separate from the attachment point of the additional boom and then a similar mounting element is preferably used for mounting the additional supporting arm. The mounting element 5 of the invention can be movably mounted on any of the extension parts of the telescopic boom or if desired on the base part 7 of the telescopic boom or on the frame 6 of the crane, which latter embodiment gives a high lifting capacity even if the working space must be somewhat bigger. If the mounting element 5 is mounted on the base part 7 of the telescopic boom or on the frame 6 of the crane these have to be provided with some sort of rails or the like for the mounting element to move along, as the roll arrangement used on the boom parts cannot be applied here. It is evident that sliding surfaces or the like can be used instead of rolls on the boom.

For controlling of the mounting element 5 and an optional second mounting element for the additional supporting arm 4, which second element is not shown in the figures, prior known means are used, such as hydraulic cylinders or a hoist. The mounting elements can naturally be moved by the movement of the telescopic boom only, in which case the mounting element is locked in a desired position on the telescopic boom. A movable and controllable mounting element for attaching the additional boom and/or the additional supporting arm gives naturally an versatile adjusting of the crane and accordingly very good performance values. Attaching of the additional boom can, however, successively be made to a joint on the boom to which the boom and/or arm is articulatedly attached. With a boom system according to the invention it is thus possible to make the control of the additional boom means more versatile and less complicated than in the previously known models with the additional boom attached to the upper end of the boom. By means of controlling the length of the telescopic boom, for example, it is possible to adjust, without steps, the supporting wires 3, the additional boom 1 and the additional supporting arm 4 to numerous positions from the operator's cab. Respectively, when using constructions having the additional boom installed at the upper end, it is not possible to change the angle between the supporting wire and the additional boom by adjusting the length of the telescopic boom. Controlling of the additional boom means attached to the telescopic boom is performed hydraulically or mechanically, preferably so that the additional boom is mechanically controlled with a hoist and the additional supporting arm is hydraulic-mechanically controlled or only hydraulically or only mechanically. Controlling of both the additional boom and the additional supporting arm of the embodiments according to the figures is performed by means of hoist including wires, pulleys and drums.

What is claimed is:

1. A self-propelled telescopic boom-type crane having a plurality of telescoping segments forming a telescopic boom pivotally mounted on a self propelled base a secondary boom having an outer and an inner end, the inner end of said secondary boom being pivotally mounted on a mounting element, said mounting element being mounted on and in longitudinal sliding relationship with respect to one of the telescoping segments of said telescopic boom, said mounting element being spaced below the top of the telescopic boom, a supporting arm having an inner and an outer end, the inner end thereof being mounted in longitudinal sliding relationship with respect to one of the telescoping segments of said telescopic boom, said supporting arm also being pivotally mounted with respect to said telescopic boom, said secondary boom and said supporting arm extending in opposite directions from the telescopic boom and being pivotally and longitudinally movable with respect to all of said segments of the telescopic boom during operation of the crane, supporting wire means for the secondary boom and the supporting arm supported on the top of the topmost segment of the telescopic boom and extending therefrom to the outer end of the secondary boom in one direction and to the outer end of the supporting arm in the oposite direction and therefrom to controllable winding means on the frame, and said secondary boom and said supporting arm being readily removable from said telescoping boom and readily reassembled thereto whereby said telescopic boom may be used together with or without the secondary boom and the supporting arm.

2. The device of claim 1 in which said supporting arm is pivotally mounted on the same mounting element as the secondary boom.

* * * * *